US009752752B2

(12) United States Patent
Gassner et al.

(10) Patent No.: US 9,752,752 B2
(45) Date of Patent: Sep. 5, 2017

(54) LED LUMINAIRE HAVING DIFFERENTLY SETTABLE LIGHT DISTRIBUTIONS

(71) Applicant: ZUMTOBEL LIGHTING GMBH, Dornbirn (AT)

(72) Inventors: Patrik Gassner, St. Gerold (AT); Bert Junghans, Goefis (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 14/786,909

(22) PCT Filed: Apr. 24, 2014

(86) PCT No.: PCT/EP2014/058365

§ 371 (c)(1),
(2) Date: Oct. 23, 2015

(87) PCT Pub. No.: WO2014/174024

PCT Pub. Date: Oct. 30, 2014

(65) Prior Publication Data

US 2016/0061411 A1 Mar. 3, 2016

(30) Foreign Application Priority Data

Apr. 26, 2013 (DE) ..... 10 2013 207 663

(51) Int. Cl.
*F21V 5/08* (2006.01)
*F21S 8/06* (2006.01)
(Continued)

(52) U.S. Cl.
CPC ..... *F21V 5/08* (2013.01); *F21S 8/046* (2013.01); *F21S 8/06* (2013.01); *F21V 7/0083* (2013.01);
(Continued)

(58) Field of Classification Search
CPC ..... F21V 5/08; F21V 7/0083; F21V 23/04; F21S 8/046; F21S 8/06; F21W 2101/02; F21W 2131/402; F21Y 2101/00
(Continued)

(56) References Cited

U.S. PATENT DOCUMENTS 5,819,454 A * 10/1998 Rosenitsch ..... G09F 9/3023 340/815.45
8,220,962 B2 7/2012 Cheng
(Continued)

FOREIGN PATENT DOCUMENTS

DE 3301277 8/1983
DE 202009017096 3/2010
(Continued)

OTHER PUBLICATIONS

Google translation of patent CN101220928B dated Oct. 16, 2016; pp. 1-14.*
(Continued)

*Primary Examiner* — Laura Tso
(74) *Attorney, Agent, or Firm* — Brooks Kushman P.C.

(57) ABSTRACT

A luminaire which has at least one first LED light source for emitting a first light, at least one first light-directing element for influencing the direction of the first light, at least one second LED light source for emitting a second light, and at least one second light-directing element for influencing the direction of the second light. The first light-directing element is in this case configured in such a way that it affects an asymmetric light output of the first light. The second light-directing element has an identical configuration to the first light-directing element and is arranged in a position rotated through 180° relative to the first light-directing element. When the first LED light source is switched ON and the second LED light source is switched OFF, an
(Continued)

Figure 1:
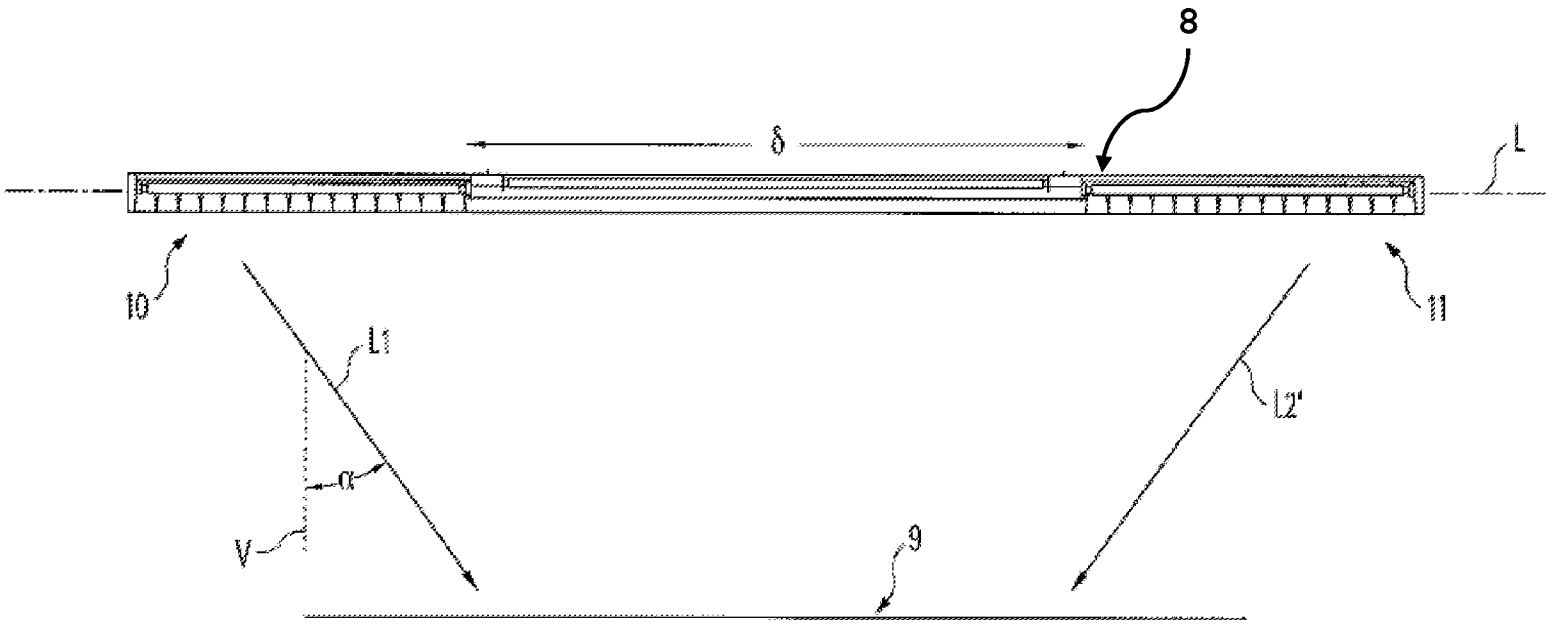

asymmetrical light output which is particularly suitable as task lighting can be achieved by the luminaire.

18 Claims, 5 Drawing Sheets

(51) Int. Cl.

| | |
|---|---|
| ***F21V 7/00*** | (2006.01) |
| ***F21S 8/04*** | (2006.01) |
| ***F21V 23/04*** | (2006.01) |
| *F21W 101/02* | (2006.01) |
| *F21W 131/402* | (2006.01) |
| *F21Y 115/10* | (2016.01) |

(52) U.S. Cl.
CPC ..... *F21V 23/04* (2013.01); *F21W 2101/02* (2013.01); *F21W 2131/402* (2013.01); *F21Y 2115/10* (2016.08)

(58) Field of Classification Search
USPC ..... 362/33, 236, 237, 238, 239, 240, 247
See application file for complete search history.

(56) References Cited

U.S. PATENT DOCUMENTS

| | | | |
|---|---|---|---|
| 2006/0050528 | A1 | 3/2006 | Lyons et al. |
| 2012/0033426 | A1 | 2/2012 | Wendt |
| 2014/0160756 | A1 | 6/2014 | Ebner et al. |

FOREIGN PATENT DOCUMENTS

| | | |
|---|---|---|
| DE | 202009014873 | 5/2010 |
| DE | 102010062454 | 6/2011 |
| DE | 102010014209 | 10/2011 |
| DE | 102011079404 | 1/2013 |
| DE | 102011080313 | 2/2013 |
| EP | 1953449 | 8/2008 |
| EP | 2039985 | 3/2009 |
| WO | 2009094819 | 8/2009 |

OTHER PUBLICATIONS

International Search Report for PCT/EP2014/058365, English translation attached to original, Both completed by the European Patent Office on Jun. 26, 2014, All together 7 Pages.

* cited by examiner

LED LUMINAIRE HAVING DIFFERENTLY SETTABLE LIGHT DISTRIBUTIONS

CROSS-REFERENCE TO RELATED APPLICATION

This application is the U.S. national phase of PCT Application No. PCT/EP2014/058365 filed on Apr. 24, 2014, which claims priority to DE Patent Application No. 10 2013 207 663.0 filed on Apr. 26, 2013, the disclosures of which are incorporated in their entirety by reference herein.

The invention relates to a luminaire with LED light sources (LED: light-emitting diode) and light-guiding elements for influencing the direction of the light.

DE 10 2010 062 454 A1 has disclosed such an LED luminaire with a plurality of LEDs, in which each LED is assigned a light-guiding element in the form of a reflector.

A workspace luminaire is known from DE 33 01 277 C2. This luminaire is an elongate luminaire with two light-emission arrangements; the luminaire is provided to be arranged over a worktop such that it illuminates a work area on the worktop from an oblique top left with the first light-emission arrangement and from an oblique top right with the second light-emission arrangement.

In general, a plurality of different illumination forms are desired in office spaces with corresponding workspaces, namely depending on the nature of the region that is intended to be illuminated or on what situation is present. By way of example, what is often desired in a workspace-related illumination is that the luminaires used for the illumination, such as e.g. the aforementioned workspace luminaire known from DE 33 01 277 C2, have an asymmetric light emission. As a result of the oblique illumination over the work area, it is possible to reduce or even avoid unwanted shadow formation or blinding effects. In contrast to such a workspace-related illumination, a symmetric light emission is typically desired for general illumination, for example for illuminating a corridor or the like.

Therefore, a plurality of different luminaires are conventionally used in offices or corresponding rooms.

The invention is based on the object of specifying a luminaire which is particularly suitable both for workspace-related illumination and for general illumination.

According to the invention, this object is achieved by the subject matter specified in the independent claim. Particular embodiments of the invention are specified in the dependent claims.

According to the invention, provision is made for a luminaire which comprises at least one first LED light source for emitting a first light, at least one first light-guiding element for influencing the direction of the first light, at least one second LED light source for emitting a second light, and at least one second light-guiding element for influencing the direction of the second light. Here, the at least one first light-guiding element is configured in such a way that it brings about an asymmetric light emission of the first light. The at least one second light-guiding element is configured in a structurally identical manner to the at least one first light-guiding element and, in the process, is arranged in a position rotated by 180° relative to the at least one first light-guiding element.

When the at least one first LED light source is switched on and the at least one second LED light source is switched off, the luminaire can achieve an asymmetric light emission, which is particularly suitable as workspace-related illumination; by contrast, when the aforementioned LED light sources are all switched on, it is possible to achieve a symmetric light emission, i.e. a light emission which is particularly suitable for general illumination. Furthermore, what is rendered possible by switching on the at least one second LED light source and switching off the at least one first light source is bringing about a further asymmetric light emission which, in terms of the main emission direction thereof, differs from the aforementioned asymmetric light emission.

The at least one first light-guiding element preferably comprises a lens or it consists of a lens in a manner advantageous from an optical and production point of view.

In a manner advantageous from an optical point of view, the at least one first light-guiding element and the at least one second light-guiding element are configured and arranged in such a way that the first light and the second light can be emitted together by the luminaire in the form of a batwing distribution.

Preferably, the luminaire furthermore comprises a control unit for actuating the at least one first LED light source and the at least one second LED light source, wherein the control unit is configured in such a way that, in a first switching state of the control unit, the first light is emitted by the luminaire and the second light is not emitted or emitted with an intensity that is lower than the intensity of the first light and, in a second switching state of the control unit, the first light is emitted with the same intensity as the second light. This renders possible a particularly simple operation of the luminaire.

Preferably, the control unit is furthermore configured in such a way that the first light is emitted with a higher intensity by the luminaire in the first switching state than in the second switching state. What can be achieved thereby is that the same illumination level is achieved in both switching states.

The luminaire is particularly suitable for illuminating a work region when the at least one first LED light source, the at least one first light-guiding element, the at least one second LED light source and the at least one second light-guiding element form parts of a first light-emission arrangement of the luminaire, wherein the first light-emission arrangement is configured to illuminate a work region from a side that is obliquely from above.

Preferably, the first light-emission arrangement comprises a plurality of first LED light sources, a plurality of first light-guiding elements, a plurality of second LED light sources and a plurality of second light-guiding elements. Here, furthermore, respectively one of the first LED light sources and one of the first light-guiding elements and one of the second LED light sources and one of the second light-guiding elements are preferably arranged immediately adjacent to one another and form a light-emission unit of the first light-emission arrangement, with the light-emission units formed thus being arranged in a field-like manner. As a result of this, a particularly uniform light emission of the luminaire is made possible in different switching states of the control unit.

Furthermore preferably, the luminaire moreover comprises a second light-emission arrangement, which is configured to illuminate the work region from a side, lying opposite to the side mentioned above, that is obliquely from above. Here, furthermore preferably, the second light-emission arrangement has an analog, in particular structurally identical, configuration to the first light-emission arrangement.

The luminaire is particularly suitable to illuminate a work region when it is elongate overall such that it has a longitudinal axis, wherein the configuration is such that, in an orientation provided for the operation of the luminaire, the longitudinal axis has horizontal alignment.

The luminaire is particularly preferably a suspended luminaire or free-standing luminaire.

Figure 2:
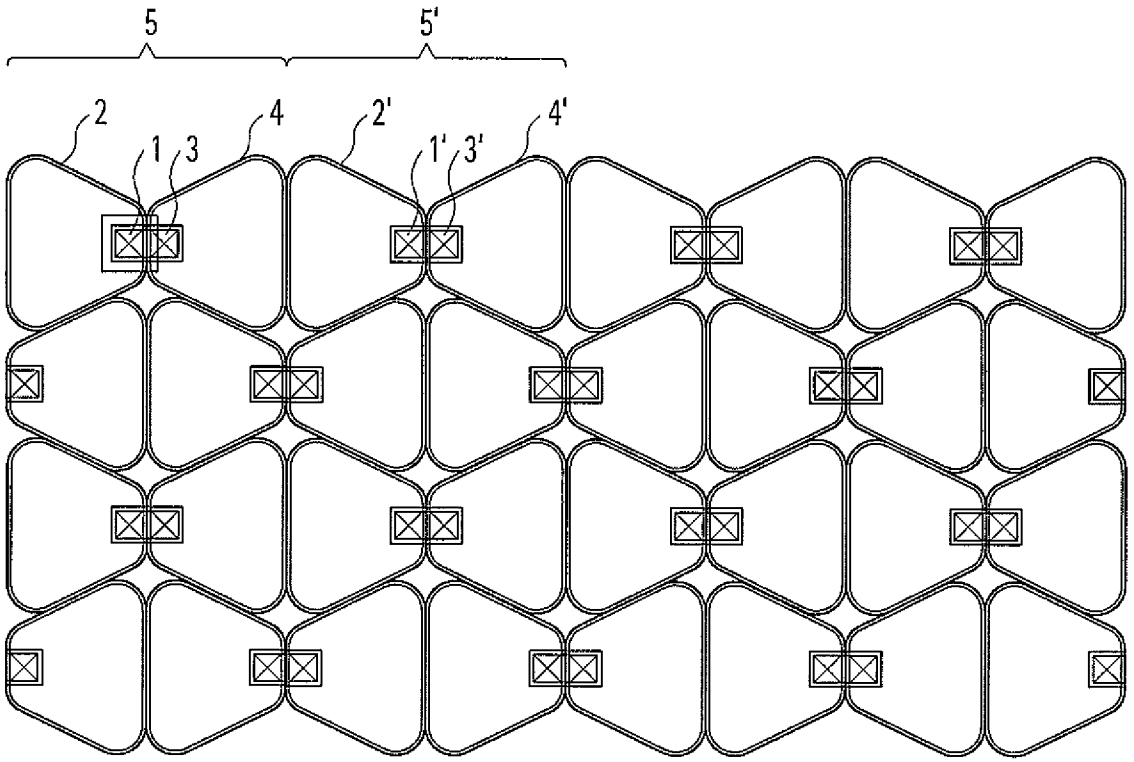
Figure 3:
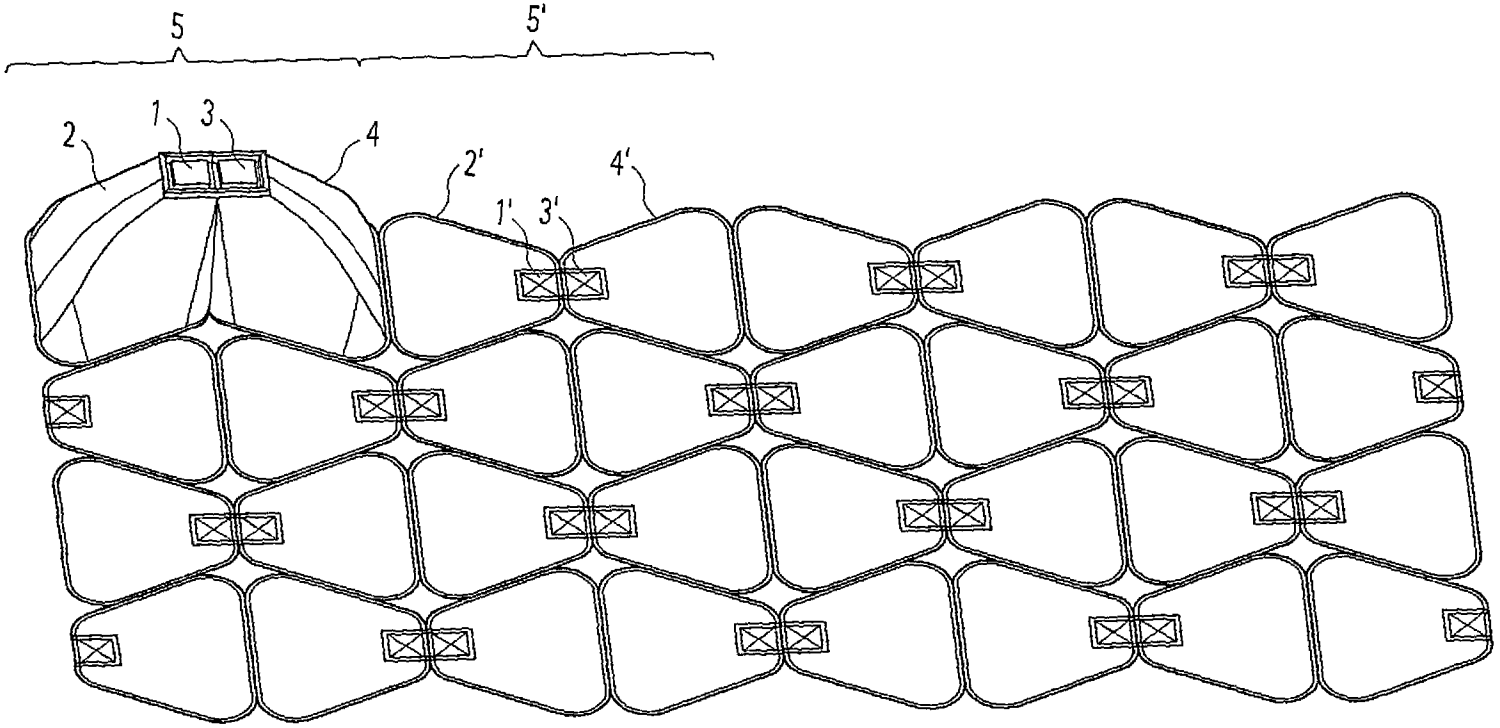
Figure 5:
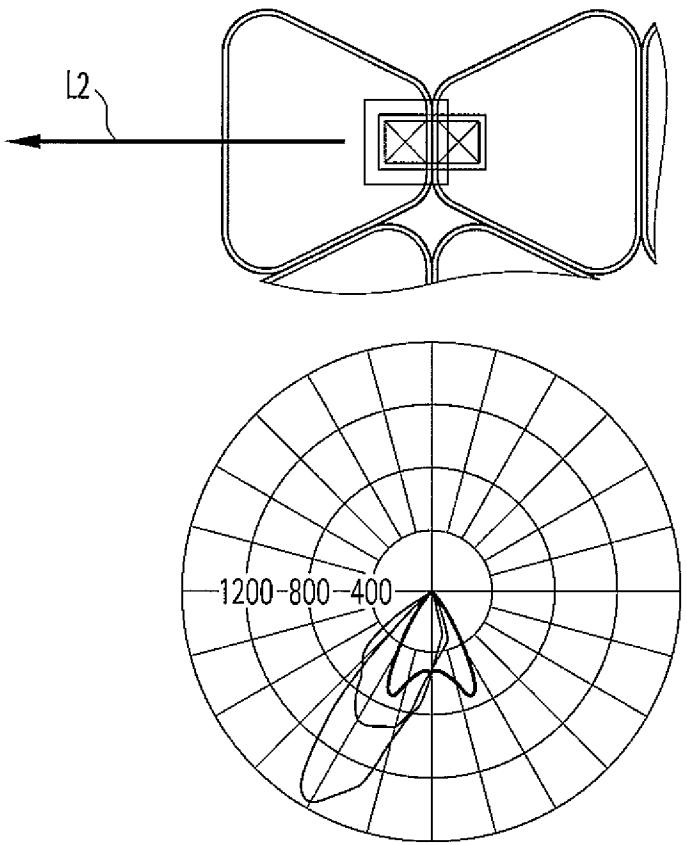
Figure 4:
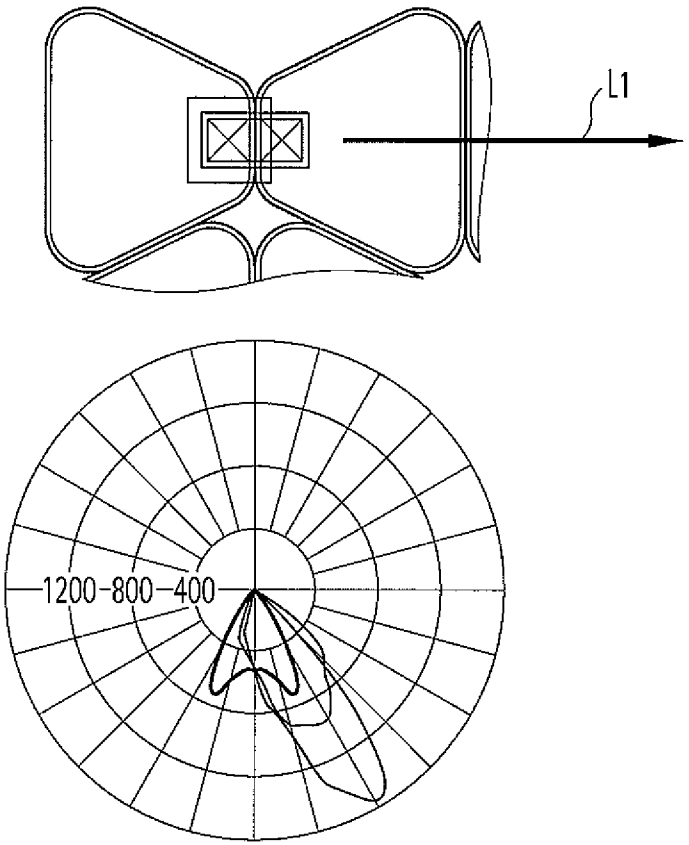
Figure 6:
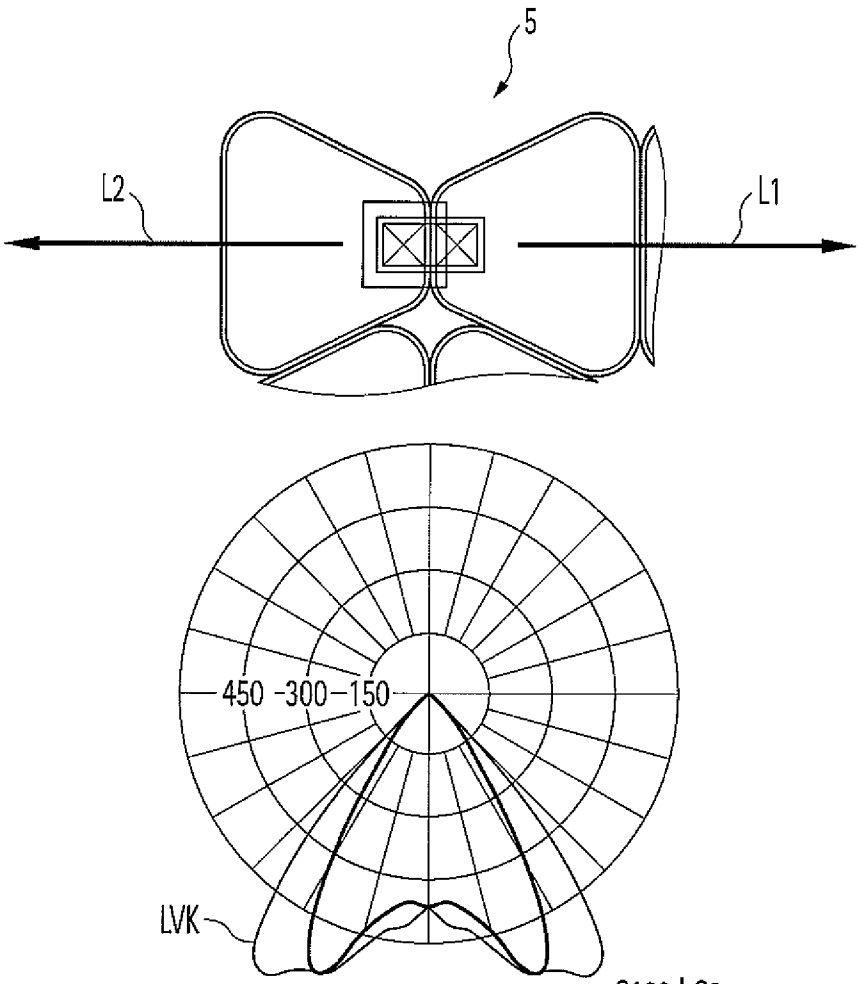

Below, the invention will be explained in more detail on the basis of an exemplary embodiment and with reference to the figures. In detail:

FIG. 1 shows a sketch of an exemplary embodiment of a luminaire according to the invention, FIG. 2 shows a sketch in the style of a view from below onto the first light-emission arrangement of the luminaire, FIG. 3 shows a further sketch in relation to the configuration of the first light-emission arrangement, wherein a first light-guiding element and a second light-guiding element are indicated in a perspective manner, FIG. 4 shows a sketch in relation to the emission of the first light, FIG. 5 shows a corresponding sketch in relation to the emission of the second light and FIG. 6 shows a corresponding sketch in relation to the emission of the first and the second light.

FIG. 1 shows a sketch in relation to an exemplary embodiment of a luminaire according to the invention. The luminaire is configured in the form of an office luminaire and provided to illuminate a work region 9.

By way of example, the luminaire can be a suspended luminaire or a free-standing luminaire. Corresponding suspension elements or a corresponding stand are not shown in FIG. 1. The work region 9 can be e.g. a horizontal work area, which is provided by a surface region of a desk.

In the shown example, the luminaire overall has an elongate configuration such that it extends along a longitudinal axis L. The luminaire has an elongate housing 8 which is configured to be oriented horizontally in an operational state such that the longitudinal axis L extends with a horizontal alignment during the operation of the luminaire.

The luminaire preferably comprises a first light-emission arrangement 10 and preferably also a second light-emission arrangement 11, affixed to opposite ends of housing 8. The first light-emission arrangement 10 is configured to illuminate the work region 9 from a side that is obliquely from above, from obliquely top left in reference to FIG. 1. The second light-emission arrangement 11 is configured to illuminate the work region 9 from a side, lying opposite to the side mentioned first, that is obliquely from above, i.e. from obliquely top right in this case. Accordingly, the luminaire is configured in such a way that a distance $\delta$ is formed between the first light-emission arrangement 10 and the second light-emission arrangement 11, which distance is preferably greater than 30 cm, more particularly greater than 50 cm, wherein preferably no light is emitted downward by the luminaire between the two light-emission arrangements 10, 11. This is advantageous in relation to avoiding unwanted blinding effects on the work region 9.

In the shown example, the first light-emission arrangement 10 has a substantially horizontal light-emission area, which points downward.

FIG. 2 shows a schematic view from below onto the first light-emission arrangement 10, or onto the light-emission area thereof, and FIG. 3 shows a sketch relating to the design of the first light-emission arrangement 10 in the case of perspective view from obliquely above, with only certain parts being shown or indicated and not the whole first light-emission arrangement 10.

The luminaire has a first LED light source 1 for emitting a first light L1 and a first light-guiding element, comprising a lens 2 for influencing the direction of the first light L1. Furthermore, the luminaire has a second LED light source 3 for emitting a second light L2 and a second light-guiding element, comprising a lens 4 for influencing the direction of the second light L2. Here, the first LED light source 1, the first light-guiding element 2, the second LED light source 3 and the second light-guiding element 4 form components of the first light-emission arrangement 10 of the luminaire.

The first LED light source 1 can have a light-emission area, which is formed by one LED or by a plurality of LEDs, wherein this light-emission area of the first LED light source 1 is preferably configured in a horizontally oriented manner. Preferably, the first LED light source 1 has exactly or only one LED as light-emitting element. Analogous statements apply to the second LED light source 3. The first light-guiding element 2 is configured in such a way that it brings about an asymmetric light emission of the first light L1, in particular an asymmetric light emission in relation to the vertical. As emerges from FIG. 1, due to the direction being influenced by the first light-guiding element 3, the first light L1 is mainly emitted by the first light-emission arrangement 10 in a direction that includes an angle $\alpha$ from the vertical V which e.g. is greater than 10° and less than 80°, preferably greater than 20° and less than 70°, particularly preferably greater than 30° and less than 60°. An analogous statement applies to the second light-guiding element 4.

The at least one second light-guiding element 4 has a configuration that is structurally identical to the at least one first light-guiding element 2 and it is, in the process, arranged relative to the at least one first light-guiding element 2 in a position rotated by 180°. The second light L2 is therefore mainly emitted in a different direction to the first light L1.

In particular, provision can be made for the second LED light source 3 and the second light-guiding element 4 to be configured in a mirror-symmetric manner in relation to the first LED light source 1 and the first light-guiding element 2, with a corresponding plane of mirror symmetry extending vertically.

Preferably, the first LED light source 1, the first light-guiding element 2, the second LED light source 3 and the second light-guiding element 4 are configured in a manner stationary relative to one another. This is advantageous from a production point of view. Furthermore, the four aforementioned parts form a light-emission unit 5 of the first light-emission arrangement 10.

As indicated in FIGS. 2 and 3, the first light-emission arrangement 11 preferably comprises a plurality of first LED light sources 1, 1' for emitting the first light L1, a plurality of first light-guiding elements 2, 2' for influencing the direction thereof, a plurality of second LED light sources 3, 3' for emitting the second light L2 and a plurality of second light-guiding elements 4, 4' for influencing the direction thereof. Here, one of the first LED light sources 1 and one of the first light-guiding elements 2 and one of the second LED light sources 3 and one of the second light-guiding elements 4 respectively form a light-emission unit 5, 5' of the first light-emission arrangement 10, such that the latter overall comprises a plurality of light-emission units 5, 5'.

The light-emission units 5, 5' formed thus are preferably arranged in a field-type manner.

As shown in an exemplary manner in FIGS. 2 and 3, the configuration in this case is preferably such that the light-emission units 5, 5' are formed and arranged relative to one another in such a way that they engage with one another. As a result of this, particularly good light-emission efficiency is obtainable. In the shown example, respectively one light-emission unit 5, 5' is arranged offset to a further light-emission unit 5, 5' immediately adjacent to the relevant light-emission unit 5, 5'. This embodiment is advantageous because this allows an impression of a planar light emission that is as uniform as possible to be obtained. However, in this respect, other configurations are also possible, for example in the form of a corresponding light-emission unit which, however, has a hexagonal configuration in a horizontal section. However, the configuration shown in FIGS. 2 and 3 is particularly suitable in relation to the optical appearance.

If the at least one first LED light source 1 has exactly or only one LED as light-emitting element and an analogous statement applies to the at least one second LED light source 3, the light-emission unit 5 or the light-emission units 5, 5' can be configured to take up particularly little space and, moreover, this allows a light emission with a particularly uniform appearance to be brought about.

Preferably, the second light-emission arrangement 11 has an analog or structurally identical configuration in relation to the first light-emission arrangement 10.

In the example shown, the at least one first light-guiding element 2 comprises a lens or consists of a lens.

FIG. 6 sketches a light-emission unit 5 and the corresponding light emission is indicated by two arrows. Sketched below in polar coordinates is an associated light distribution curve LVK (thin curve) in a vertical plane extending through the longitudinal axis L. As emerges in an exemplary manner from the light distribution curve LVK, the at least one first light-guiding element 2 and the at least one second light-guiding element 4 are preferably arranged and configured in such a way that the first light L1 and the second light L2 can be emitted together in the form of a batwing distribution by the luminaire or the first light-emission arrangement 10.

Furthermore, the luminaire preferably moreover comprises a control unit (not shown in the figures) for the electronic actuation of the at least one first LED light source 1 and the at least one second LED light source 3, wherein the control unit is configured in such a way that, in a first switching state of the control unit, the first light L1 is emitted by the luminaire and the second light L2 is not emitted or emitted with an intensity that is lower than the intensity of the first light and, in a second switching state of the control unit, the first light L1 is emitted with the same intensity as the second light L2. The light-emission situation described above on the basis of FIG. 6 therefore corresponds to the second switching state. FIG. 4 indicates, in an analogous manner, the first switching state in a sketched manner, with the second light L2 not being emitted in this case. FIG. 5 shows, likewise in an analogous manner, a further possible, third switching state of the control unit, which corresponds analogously to the first switching state, in which the second light L2 is emitted and the first light L1 is not emitted or emitted with an intensity that is lower than the intensity of the second light L2.

Furthermore, the control unit is in this case preferably moreover configured in such a way that the first light L1 is emitted with a higher intensity in the first switching state than in the second switching state. What can be obtained in this manner is that a uniform illumination level is maintained or ensured in both aforementioned switching states. An analogous statement applies in relation to the third switching state compared to the second switching state.

Thus, in relation to a vertical plane oriented normally to the longitudinal axis L, the second switching state enables a symmetric light emission of the luminaire, in particular in the form of a batwing distribution, which is therefore particularly suitable for a general illumination or a "planar" illumination. By contrast the first switching state or, optionally, analogously the third switching state enables an asymmetric light emission of the luminaire in relation to the aforementioned vertical plane, which light emission is therefore particularly suitable for a workspace-related illumination.

Naturally, the control unit can furthermore advantageously be embodied for an actuation, with a correspondingly analog configuration, of the second light-emission arrangement 11. In this way it is possible—as indicated in FIG. 1—e.g. to illuminate the work region 9 from obliquely top left with the first light L1 by the first light-emission arrangement 10 and from obliquely top right with the analogously formed second light L2' by the second light-emission arrangement 11.

By way of example, if—with reference to the illustration of FIG. 1—a corridor is situated to the left of the work region 9 or the desk, the first light-emission arrangement 10 can advantageously be set with a corresponding symmetric light emission, i.e. the first light L1 and the second light L2; this allows a particularly suitable illumination of the corridor to be obtained.

As mentioned above, the second light L2 need not necessarily be completely switched off during the first switching state. Provision can be made for the second light L2 to be activated with a lower intensity compared to the first light L1. As a result of this, it is possible to obtain an improvement in the optical impression. An analogous statement optionally once again applies accordingly to the third switching state.

The invention claimed is:

1. A luminaire, comprising:

an elongate housing extending along an axis L and configured to be horizontally oriented above a horizontal work surface, a first light-emission arrangement affixed one end of the housing, the first light-emission arrangement comprising, at least one first LED light source for emitting a first light, at least one first light-guiding element for influencing the direction of the first light, at least one second LED light source for emitting a second light, and at least one second light-guiding element for influencing the direction of the second light, wherein the at least one first light-guiding element is configured in such a way that it brings about an asymmetric light emission of the first light, wherein the at least one second light-guiding element is configured in a structurally identical manner to the at least one first light-guiding element and, in the process, is arranged in a position rotated by 180° relative to the at least one first light-guiding element, wherein the first light-emission arrangement is configured to illuminate the work surface from a first side obliquely inward from axis L above, and a second light-emission arrangement affixed the opposite end of the housing, the second light emitting arrangement comprising:

at least one first LED light source for emitting a first light, at least one first light-guiding element for influencing the direction of the first light, at least one second LED light source for emitting a second light, and at least one second light-guiding element for influencing the direction of the second light, wherein the at least one first light-guiding element of the second light emission arrangement is configured in such a way that it brings about an asymmetric light emission of the first light, wherein the at least one second light-guiding element is configured in a structurally identical manner to the at least one first light-guiding element and, in the process, is arranged in a position rotated by 180° relative to the at least one first light-guiding element, wherein the second light-emission arrangement is configured to illuminate the work surface from a first side obliquely inward from axis L above.

2. The luminaire as claimed in claim 1, in which the at least one first light-guiding element comprises a lens.

3. The luminaire as claimed in claim 1, in which the at least one first light-guiding element and the at least one second light-guiding element are configured and arranged in such a way that the first light and the second light can be emitted together by the luminaire in the form of a batwing distribution.

4. The luminaire as claimed in claim 1, furthermore comprising:

a control unit for actuating the at least one first LED light source and the at least one second LED light source, wherein the control unit is configured in such a way that, in a first switching state of the control unit, the first light is emitted by the luminaire and the second light is not emitted or emitted with an intensity that is lower than the intensity of the first light and, in a second switching state of the control unit, the first light is emitted with the same intensity as the second light.

5. The luminaire as claimed in claim 4, in which the control unit is furthermore configured in such a way that the first light is emitted with a higher intensity by the luminaire in the first switching state than in the second switching state.

6. The luminaire as claimed in claim 1, in which the first light-emission arrangement comprises a plurality of first LED light sources, a plurality of first light-guiding elements, a plurality of second LED light sources and a plurality of second light-guiding elements.

7. The luminaire as claimed in claim 6, in which respectively one of the first LED light sources and one of the first light-guiding elements and one of the second LED light sources and one of the second light-guiding elements are arranged immediately adjacent to one another and form a light-emission unit of the first light-emission arrangement, wherein the light-emission units are formed and arranged in a field-like manner.

8. The luminaire as claimed in claim 1, in which the second light-emission arrangement has an analog, structurally identical, configuration to the first light-emission arrangement.

9. The luminaire as claimed in claim 1, which is elongate overall such that it has a longitudinal axis, wherein the configuration is such that, in an orientation provided for the operation of the luminaire, the longitudinal axis has horizontal alignment.

10. The luminaire as claimed in claim 1, in the form of a suspended luminaire or free-standing luminaire.

11. The luminaire as claimed in claim 1, wherein the first and second light-emission arrangements are spaced a distance of at least 30 cm apart.

12. The luminaire as claimed in claim 1, wherein the first and second light-emission arrangements are spaced a distance of at least 50 cm apart.

13. The luminaire as claimed in claim 12, wherein first and second light-emission arrangements illuminate the work surface obliquely inward at an angle $\alpha$ relative to a vertical axis V which intersects the axis L, where angle $\alpha$ is greater than 20° and less than 70°.

14. The luminaire as claimed in claim 12, wherein in the space between the first and second light-emission arrangements no light is emitted downwardly by the luminaire.

15. The luminaire as claimed in claim 14, wherein first and second light-emission arrangements illuminate the work surface obliquely inward at an angle $\alpha$ relative to a vertical axis V which intersects the axis L, where angle $\alpha$ is greater than 30° and less than 60°.

16. A luminaire, comprising:

an elongate housing extending along an axis L and configured to be horizontally oriented above a horizontal work surface, a first light-emission arrangement affixed one end of the housing, the first light-emission arrangement comprising, at least one first LED light source for emitting a first light, at least one first light-guiding element for influencing the direction of the first light, at least one second LED light source for emitting a second light, and at least one second light-guiding element for influencing the direction of the second light, wherein the first light-emission arrangement is configured to illuminate the work surface from a first side obliquely inward from axis L above, and a second light-emission arrangement affixed the opposite end of the housing, the second light emitting arrangement comprising:

at least one first LED light source for emitting a first light, at least one first light-guiding element for influencing the direction of the first light, and at least one second LED light source for emitting a second light, wherein the second light-emission arrangement is configured to illuminate the work surface from a first side obliquely inward from axis L above.

17. The luminaire as claimed in claim 16, wherein in the space between the first and second light-emission arrangements no light is emitted downwardly by the luminaire.

18. The luminaire as claimed in claim 17, wherein first and second light-emission arrangements illuminate the work surface obliquely inward at an angle $\alpha$ relative to a vertical axis V which intersects the axis L, where angle $\alpha$ is greater than 30° and less than 60°.

* * * * *